US007641087B2

(12) United States Patent
Chang

(10) Patent No.: US 7,641,087 B2
(45) Date of Patent: Jan. 5, 2010

(54) DISPENSING DEVICE FOR ADHESIVE TAPE

(76) Inventor: Chi-Tsai Chang, No. 39, Sec. 3, Han Kou Rd., Taichung City (TW)

( * ) Notice: Subject to any disclaimer, the term of this patent is extended or adjusted under 35 U.S.C. 154(b) by 311 days.

(21) Appl. No.: 11/556,192

(22) Filed: Nov. 3, 2006

(65) Prior Publication Data

US 2008/0105723 A1 May 8, 2008

(51) Int. Cl.
*B65H 35/07* (2006.01)

(52) U.S. Cl. ..... 225/43; 242/588.3; 225/47

(58) Field of Classification Search ..... 225/47, 225/43, 1, 53, 52, 46, 65, 77, 45; 264/242; 426/115; D19/69, 67, 77, 65, 68; D9/419, D9/415; 242/588.3; 156/577, 526
See application file for complete search history.

(56) References Cited

U.S. PATENT DOCUMENTS 2,681,186 A * 6/1954 Slawik ..... 225/44
2,750,029 A * 6/1956 Morgan ..... 225/7
3,034,691 A * 5/1962 Gershen ..... 225/25
3,791,601 A * 2/1974 Broden ..... 242/419
4,088,276 A * 5/1978 Littleton ..... 242/396.5
4,787,543 A * 11/1988 Fabo et al. ..... 225/19
5,133,980 A * 7/1992 Ream et al. ..... 426/115
5,294,068 A * 3/1994 Baro et al. ..... 242/588.6
5,634,570 A * 6/1997 Casper et al. ..... 221/73
D399,603 S * 10/1998 Hemsley et al. ..... D28/66
6,364,188 B1 * 4/2002 Dunshee ..... 225/1
6,464,077 B1 * 10/2002 Liu ..... 206/388
6,763,988 B2 * 7/2004 Huang ..... 225/43
6,860,195 B2 * 3/2005 Cunningham et al. ..... 99/450.2
D506,290 S * 6/2005 Longoni ..... D28/66

* cited by examiner

*Primary Examiner*—Kenneth E. Peterson
*Assistant Examiner*—Sean Michalski
(74) *Attorney, Agent, or Firm*—Leong C. Lei

(57) ABSTRACT

A dispensing device for adhesive tape has a flat cylindrical base member with a coaxial axle element inside for the mounting of a roll of adhesive tape. A slit is provided along the wall of the cylindrical base member through which the tape is pulled out. On a section of the wall adjacent to the slit, a curved rectangular buckle is hinged to the wall, which can be flipped away from the slit to be held at an appropriate included angle with the wall. A cutting blade is provided along the outer edge of the buckle for cutting the tape while the end of the remaining tape is automatically adhered to the edge of the buckle. When the buckle is closed to the wall, the exposed segment of the tape is folded between the buckle and the section of wall.

4 Claims, 4 Drawing Sheets

DISPENSING DEVICE FOR ADHESIVE TAPE

TECHNICAL FIELD OF THE INVENTION

The present invention generally relates to adhesive tape dispensers, and more particularly to a dispensing device where the adhesive tape and the cutting blade are concealed in a circular body member when not in use for safe and convenient carry.

DESCRIPTION OF THE PRIOR ART

As shown in FIG. 6, a conventional portable dispensing device for adhesive tape mainly contains a plastic body member 30 having a 9-like shape turned 90-degree clockwise. The body member 30 has two portions. In one portion, a tubular axle 31 is provided, on which a roll of adhesive tape 32 is mounted. A user can hold the portion in one hand and pulls out the tape by the other hand as the roll of adhesive 32 spins around the axle 31. On the other portion, a cutting blade 33 is provided having a sharp edge pointed upward. As such, the tape can be pulled to pass over and then cut by the blade 33. After cutting, the end of the remaining tape is automatically adhered to an inner side of the blade 33 so that the tape is immediately ready for another use.

The foregoing design has a number of disadvantages. First of all, the axle 31 and the roll of adhesive tape 32 have to be matched nicely; otherwise, the roll 32 will fall off easily or be too tight to spin. Secondly, when the body member 30 is held in one hand and the tape is pulled out by the other hand, the tape would usually be hindered by the hand holding the body member 30. This is especially troublesome if the tape is for medical purpose and contamination to the tape may be an issue. In addition, as the cutting blade 33 is exposed openly, it presents a potential hazard to the user.

SUMMARY OF THE INVENTION

Accordingly, the present invention provides a dispensing device for safe and convenient carry. The dispensing device has a flat cylindrical base member with a coaxial axle element inside for the mounting of a roll of adhesive tape. Along the wall of the cylindrical base member, a slit in the axial direction is provided through which a segment of the tape is pulled out. On a section of the wall adjacent to the slit, a curved rectangular buckle matching the curvature of the wall is hinged to the wall, which can be flipped away from the slit to be held at an appropriate included angle with the wall. A cutting blade is provided along the outer edge of the buckle parallel to the slit for cutting the exposed segment of the tape while the end of the remaining exposed segment of the tape is automatically adhered to the edge of the buckle. When the buckle is closed to the wall, the remaining exposed segment of the tape is folded between the buckle and the section of wall. The interfacing surfaces of the buckle and the section of the wall are patterned to reduce the contact area with the tape and the folded segment of the tape can be easily unfolded when the buckle is flipped open again.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following description are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
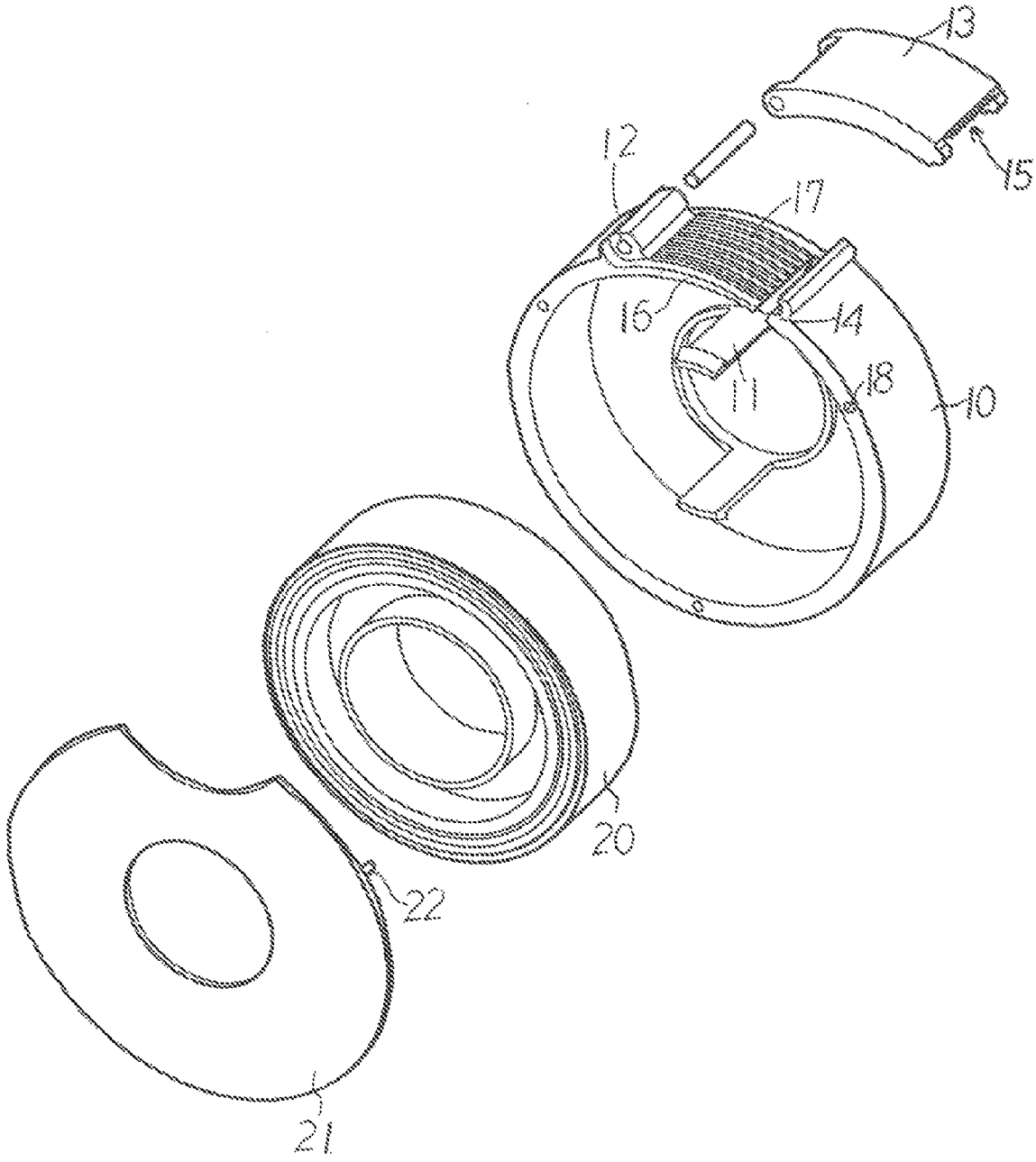
FIG. 1 is a perspective exploded view showing the various components of a dispensing device according to an embodiment of the present invention.

As illustrated in FIG. 1, a dispensing device according to an embodiment of the present invention for a roll of adhesive tape 20 has a base member 10, usually integrally formed by plastic molding. The base member 10 preferably has a shape compatible to that of the roll of adhesive tape 20. In the present embodiment, therefore, the base member 10 contains a disk having a center through hole and a circular wall perpendicularly extended from the rim of the disk. A number of elongated retaining sticks 11 are also perpendicularly extended from the rim of the center through hole for threading through the center through hole of the roll of adhesive tape 20. At the end of each retaining stick 11, a hook is provided to lock the inner rim of the roll of adhesive tape 20, but still allow the roll of adhesive tape 20 to rotate as the tape is pulled.

A section 16 of the circular wall has a patterned outer surface 17. Adjacent to an end of the section 16, a slit perpendicular to the disk is provided, through which the tape can be pulled out of the base member 10. A buckle 13 is provided, which is shaped correspondingly to the section 16 so that the buckle 13 can be fitted completely over the patterned surface 17 of section 16. The buckle 13 is pin-joined to the circular wall by a hinge 12 positioned perpendicularly to the circular wall. As such, the buckle 13 can be flipped up to reveal or closed to cover the patterned surface 17 of the section 16. A notch 14 having a C-shaped cross section whose opening faces the slit is positioned along the slit on the circular wall opposite to the section 16. Therefore, when the buckle 13 is closed, the edge of the buckle 13 opposite to the hinge 12 can be snapped into the notch 14 to retain the buckle 13. A middle section of this edge of the buckle 13 is indented appropriately where a cutting blade 15 is installed. The cutting blade 15 can also be integrally formed with the buckle 13 in alternative embodiments. On the inner surface of the buckle 13, a similar or the same patterned surface 17 is provided to interface with the patterned surface 17 of the section 16 when the buckle 13 is closed.

Figure 2:
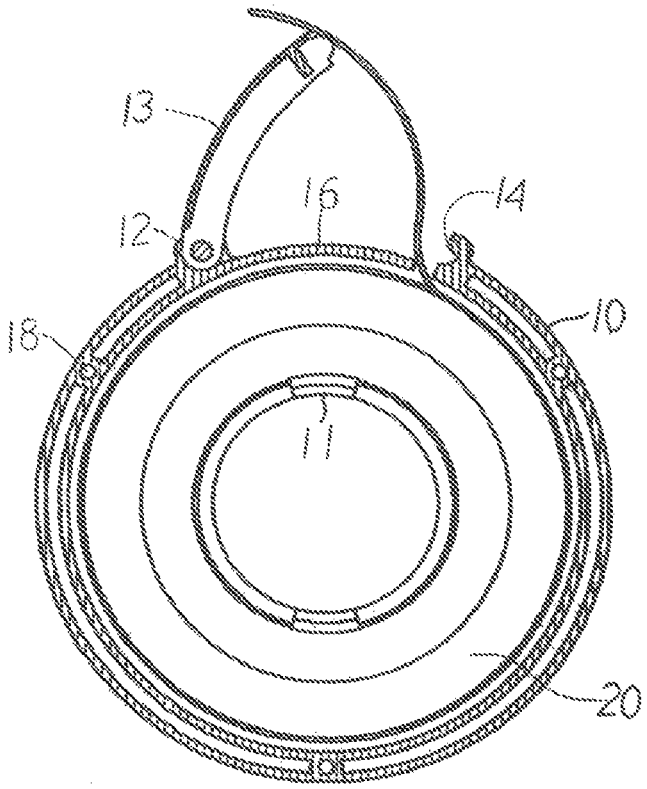
FIG. 2 is a sectional view showing the configuration of the dispensing device of FIG. 1 when the buckle is flipped open.
Figure 3:
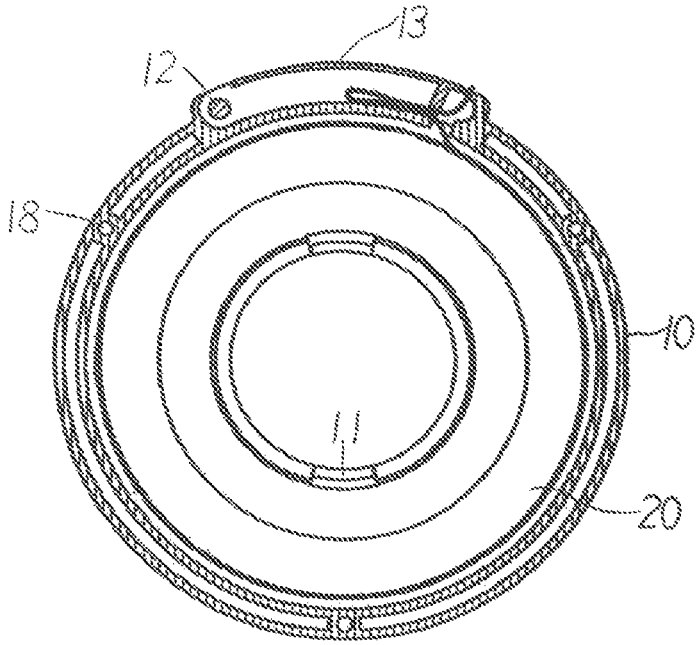
FIG. 3 is a sectional view showing the configuration of the dispensing device of FIG. 1 when the buckle is closed.

The base member 10 is sealed from a side by a circular cover plate 21 having a number of plugs 22 along the rim on the side facing the base member 10. Correspondingly, along the surface of the circular wall facing the cover plate 21, a number of holes 18 for receiving the plugs 22 are provided so that the cover plate 21 and the base member 10 can be joined together for forming a flat cylindrical body. As shown in FIGS. 2 and 3, the circular wall can have a layered structure and the provision of the holes 18 actually reinforces the strength of the base member 10.

Figure 4:
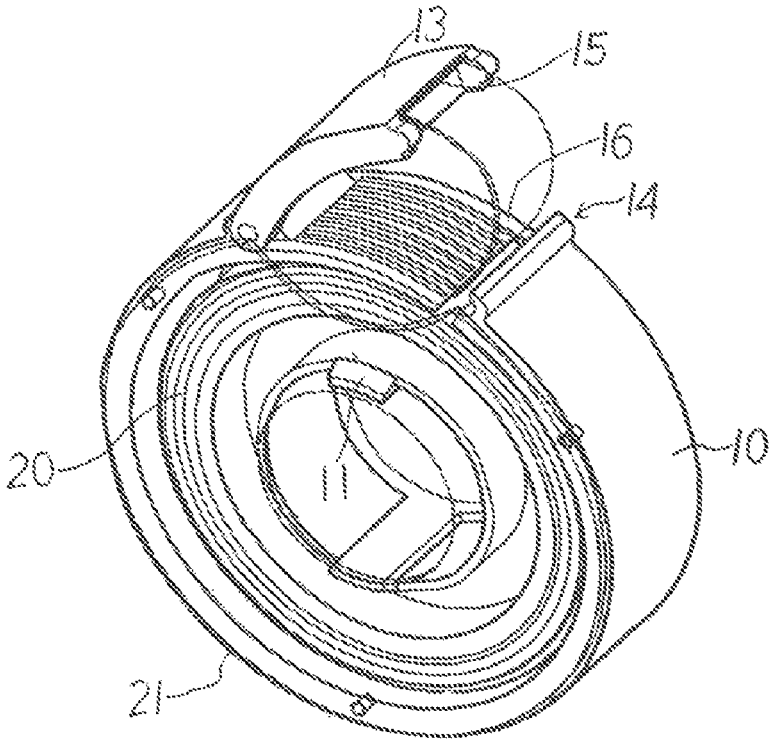
FIG. 4 is a perspective exposed view showing the configuration of the dispensing device of FIG. 1 when the device is in use.
Figure 5:
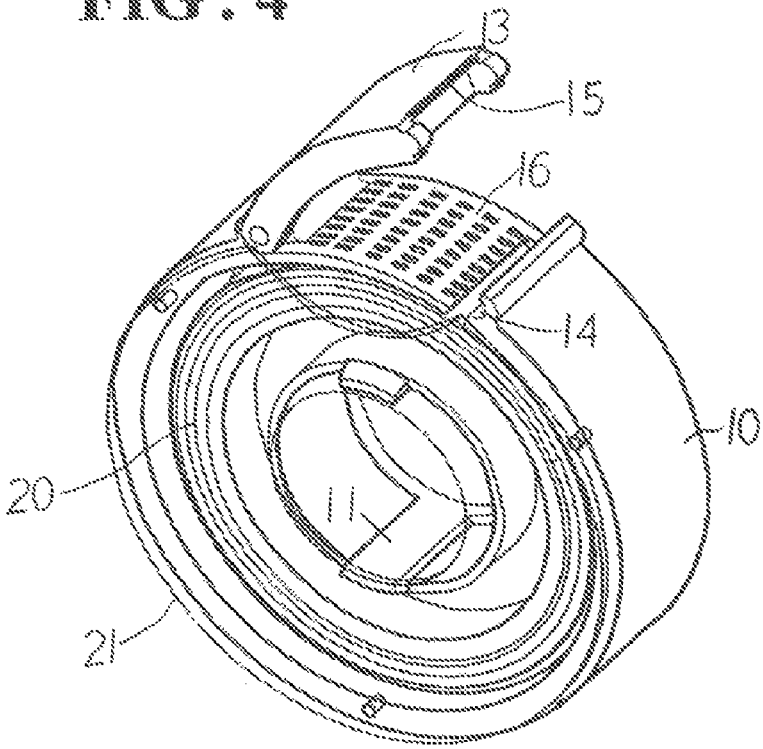
FIG. 5 is a perspective exposed view showing a dispensing device according to another embodiment of the present invention.
Figure 6:
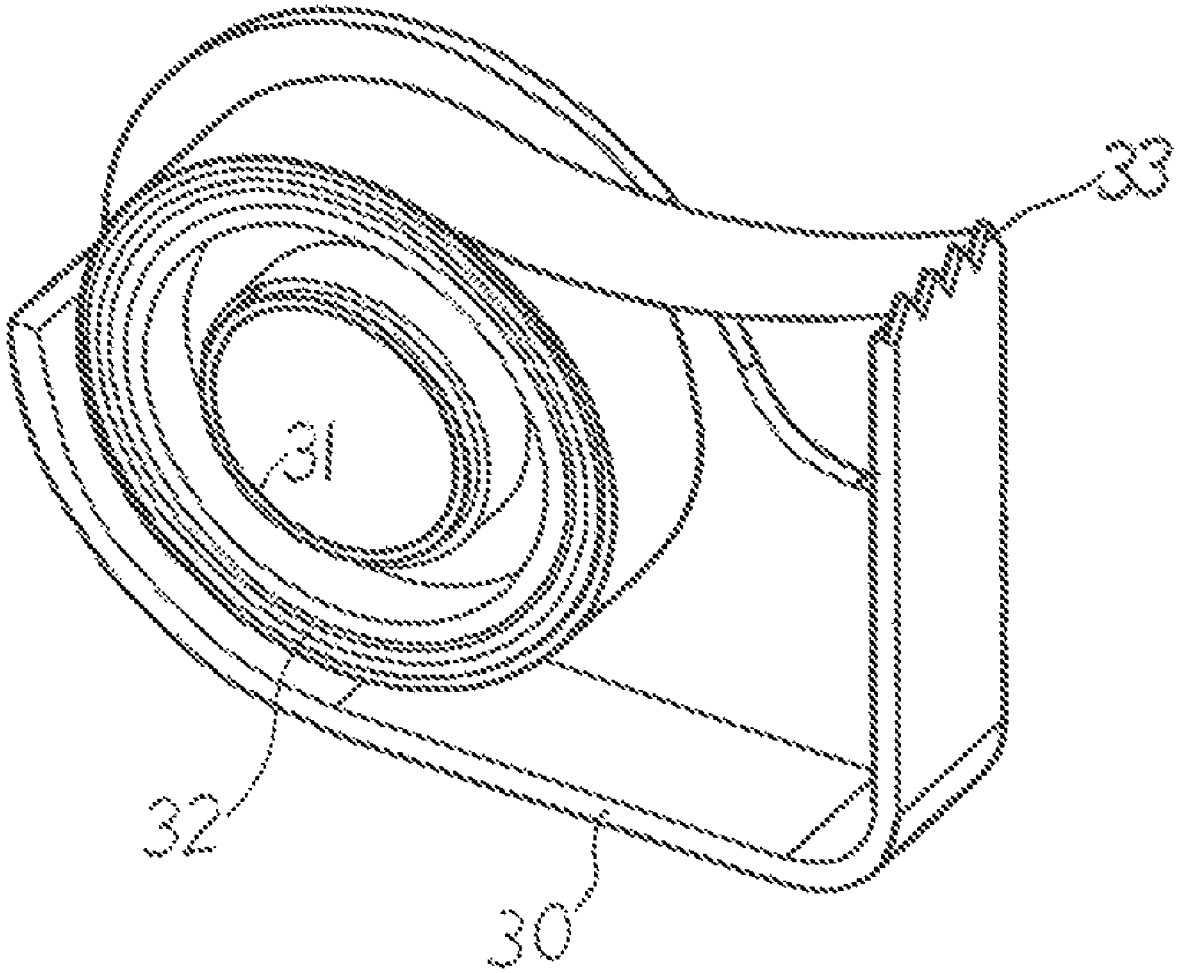
PRIOR ART FIG. 6
FIG. 6 is a perspective view showing a conventional dispensing device.

As illustrated in FIG. 2, to use the dispensing device of FIG. 1, the buckle 13 is flipped outward until it is stopped and supported by the hinge 12. The tape pulled out of the base member 10 through the slit adjacent to the section 16 can then be cut down by the cutting blade 15 of the steadily held buckle 13 with an end of the remaining exposed segment of the tape adhered to the cutting blade 15. When the dispensing device is not in use, the buckle 13 can be flipped back and snapped to the notch 14. As shown in FIG. 3, the exposed segment of the tape is, as such, folded into a U-like shape between the buckle 13 and the section 16 with the tape's adhesive surface interfacing with the patterned surfaces 17 of the buckle 13 and the section 16. When the buckle 13 is flipped open again, the folded segment of the tape will be expanded automatically and ready for use immediately (see FIG. 4). The patterned surface 17 can be a meshed surface (hollowed out or not) or an embossed surface with a particular pattern, or the patterned surface 17 can have regular grooves or spikes so as to reduce the contact area with the adhesive tape to prevent tight adhesion of the tape to the surfaces (see FIG. 5).

Another advantage of the present invention is that the dispensing device, when not in use, has a nearly airtight package. This is especially advantageous for medical personnel where contamination can be effectively prevented and the dispensing device can be conveniently carried in a pocket without any safety and hygiene issues.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A dispensing device for a roll of adhesive tape comprising:

a base member containing a disk having a center through hole and a circular wall perpendicularly extended from a rim of said disk, a plurality of elongated retaining sticks perpendicularly extending from a rim of said center through hole for threading through a center hole of said roll of adhesive tape, a section of said circular wall having a patterned outer surface, a slit perpendicular to said disk and opposite to said section being provided along said circular wall of said base member thereby enabling a segment of said adhesive tape to be pulled out of said base member, a notch formed on said circular wall and positioned along said slit of said base member in an axial direction opposite to said section;

a buckle shaped correspondingly to said section of said circular wall thereby enabling said buckle to be fitted over said patterned surface, said buckle being pin-joined to said circular wall by a hinge positioned perpendicular to said circular wall and having an outer edge opposite to said slit so that when said buckle is closed to cover said patterned surface, said outer edge of said buckle will be snapped into said notch to retain said buckle;

a cutting blade installed along outermost edge of said buckle parallel and adjacent to said slit for cutting said segment of adhesive tape while an end of remaining exposed segment of said adhesive tape adhered to said cutting blade;

wherein, when said buckle is closed to cover said patterned surface, a segment of said adhesive tape between said buckle and said slit is folded between said buckle and said section; and, when said buckle is flipped open, said folded segment of said adhesive tape is unfolded.

2. The dispensing device for a roll of adhesive tape as claimed in claim 1, wherein each of said retaining sticks is provided with a hook to lock an inner rim of said roll of adhesive tape.

3. The dispensing device for a roll of adhesive tape as claimed in claim 1, wherein said buckle has a patterned inner surface.

4. The dispensing device for a roll of adhesive tape as claimed in claim 1, wherein said base member is open at a side and said dispensing device further comprises a cover plate sealing said side of said base member.

* * * * *